US006715187B1

(12) United States Patent
Wang

(10) Patent No.: US 6,715,187 B1
(45) Date of Patent: Apr. 6, 2004

(54) ZIP FASTENER TOP-END PIECE ARRANGEMENT

(76) Inventor: Wallace Wang, No. 273, San Jiunn Street, Shu Lin Chen, Taipei Hsien (TW)

( * ) Notice: Subject to any disclaimer, the term of this patent is extended or adjusted under 35 U.S.C. 154(b) by 5 days.

(21) Appl. No.: 10/295,876

(22) Filed: Nov. 18, 2002

(51) Int. Cl.[7] ..... A44B 19/36
(52) U.S. Cl. ..... 24/436
(58) Field of Search ..... 24/387, 388, 436

(56) References Cited

U.S. PATENT DOCUMENTS 1,910,953 A * 5/1933 Johnson ..... 24/436
2,381,359 A * 8/1945 Mikulas ..... 24/404
2,423,202 A * 7/1947 Morin ..... 24/404
2,535,504 A * 12/1950 Morin ..... 24/436
4,232,431 A * 11/1980 Akashi ..... 24/388
5,860,193 A * 1/1999 Wang ..... 24/436
6,070,306 A * 6/2000 Wang ..... 24/436
6,327,755 B1 * 12/2001 Wang ..... 24/436

FOREIGN PATENT DOCUMENTS

GB 2352271 A * 1/2001 ..... A44B/19/60

* cited by examiner

*Primary Examiner*—James R. Brittain
(74) *Attorney, Agent, or Firm*—Troxell Law Office PLLC

(57) ABSTRACT

A zip fastener top-end piece arrangement in which the top-end piece of the zipper tape is formed of a top block and a bottom block, the bottom block having a top recessed hole, the top block having a bottom springy hook, which is disengaged from the top recessed hole of the bottom block to open the passage between the top block and the bottom block for enabling the zipper slide to be coupled to the zipper tape, or hooked in the top recessed hole of the bottom block to close the passage between the top block and the bottom block-after installation of the zipper slide in the zipper tape.

2 Claims, 9 Drawing Sheets

ZIP FASTENER TOP-END PIECE ARRANGEMENT

BACKGROUND AND SUMMARY OF THE INVENTION

The present invention relates to zip fasteners and, more specifically, to a zip fastener top-end piece arrangement, which effectively prevents the zipper slide from falling out of the zipper tape when the zip fastener unfastened.

The top-end pieces of regular nylon zip fasteners include two types, namely, the metal type and the plastic type. A metal top-end piece is fixedly fastened to the zipper tape and the top end of the row of teeth by crimping. A plastic top-end piece is fixedly fastened to the zipper tape and the top end of the row of teeth by an ultrasonic sealing apparatus. A metal top-end piece tends to be forced away from the zipper tape, and may injure the user's fingers easily when the user closing or opening the zip fastener. The method of fastening a plastic top-end piece to a zipper tape has drawbacks. As shown in FIG. 1, the plastic top-end piece 31 covers a part of the top sidewall of the zipper tape 3 over the top end of the row of teeth. Because the plastic top-end piece 31 is connected to the top sidewall of the zipper tape 3 only, it tends to be forced away from the zipper tape 3. Further, the sharp corner edges 311 of the plastic top-end piece 31 may injure the user's fingers accidentally when the user opening or closing the zip fastener.

The present invention has been accomplished to provide a zip fastener top-end piece arrangement, which eliminates the aforesaid drawbacks. It is one object of the present invention to provide a zip fastener top-end piece arrangement, which prohibits the zipper slide from falling out of the zipper tape. It is another object of the present invention to provide a zip fastener top-end piece arrangement, which does not injure the user's fingers when the user opening/closing the zip fastener. To achieve these and other objects of the present invention, the zip fastener top-end piece arrangement comprises a zipper tape having a longitudinal row of teeth, and a top-end piece fixedly located on the zipper tape and a top end of the longitudinal row of teeth and adapted to limit upward movement of the sipper slide being coupled to the zipper tape. The top-end piece comprises a bottom block bonded to the zipper tape and the top end of the row of teeth, and a top block injection-molded on the zipper tape and defining with the bottom block an open space. The top block comprises an outer top stop edge and a protruded inner bottom stop portion for stopping upward movement of the zipper slide being coupled to the zipper tape. The top block further comprises a springy hook downwardly extended from a bottom sidewall thereof toward the bottom block. The bottom block has a recessed hole disposed in a top side thereof and adapted to receive the springy hook. The springy hook is forced away from the recessed hole when the user inserts the zipper slide through the open space into engagement with the zipper tape. The springy hook is forced into engagement with the recessed hole by the zipper slide being coupled to the zipper tape when the zipper slide being coupled to the zipper tape pulled upwards to the top block.

DETAILED DESCRIPTION OF THE PREFERRED EMBODIMENT

Figure 1:
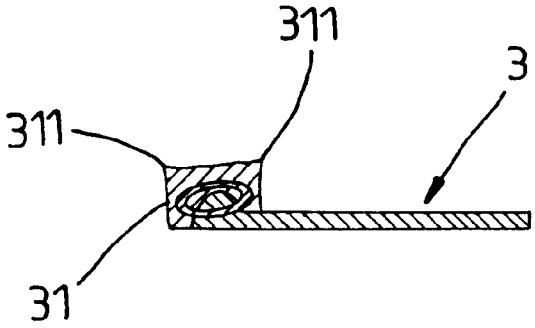
Fig. 1 PRIOR ART
FIG. 1 is a sectional view of a zipper tape for nylon zip fastener according to the prior art, showing the structure of the top-end piece.
Figure 2:
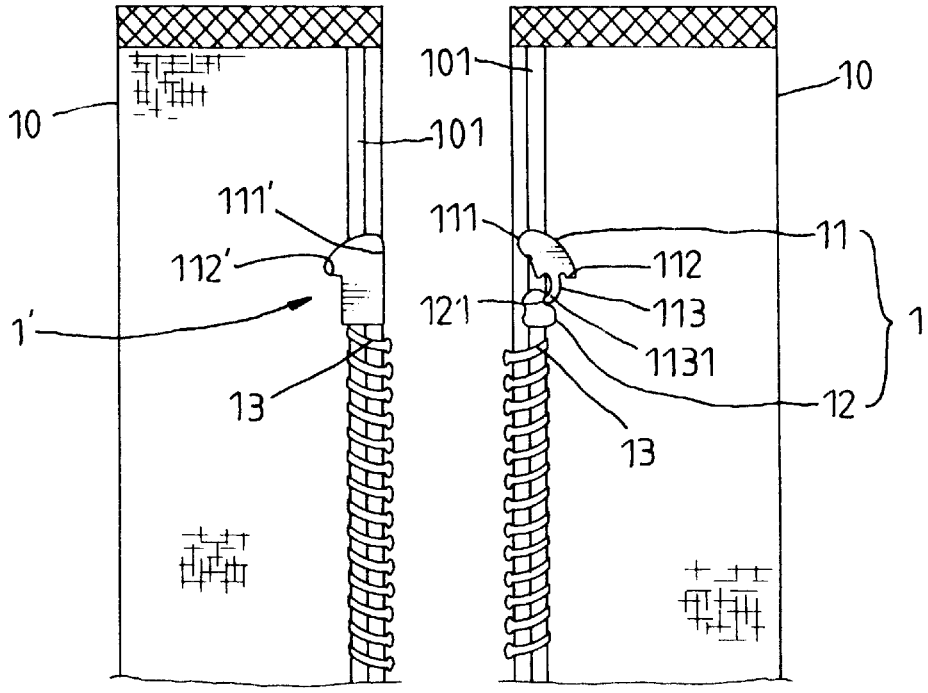
FIG. 2 is a plain view of a nylon zip fastener according to the present invention before installation of the zipper slide.
Figure 5:
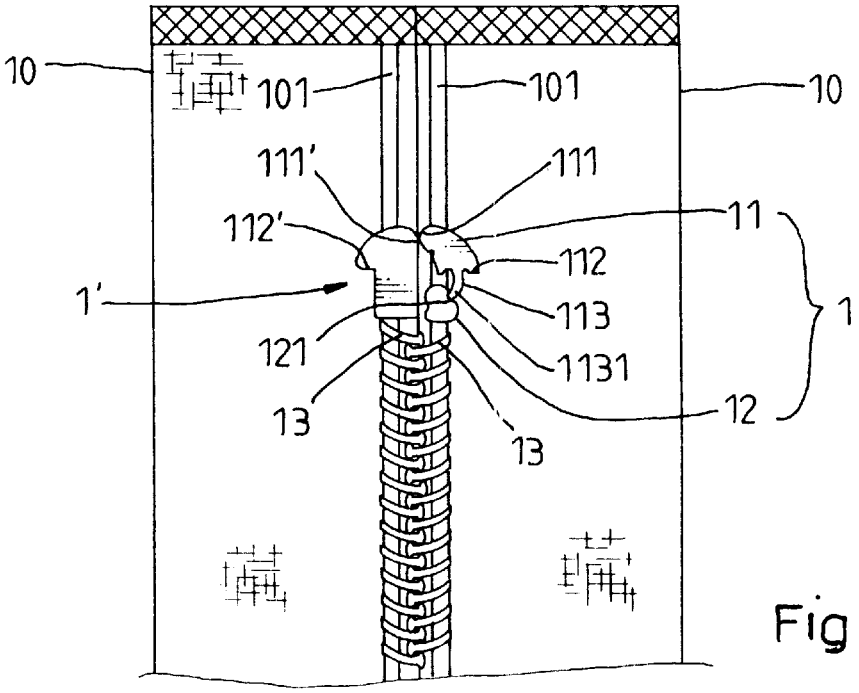
FIG. 5 is a plain view of the nylon zip fastener according to the present invention, showing the rows of teeth of the zipper tapes interlocked.
Figure 3:
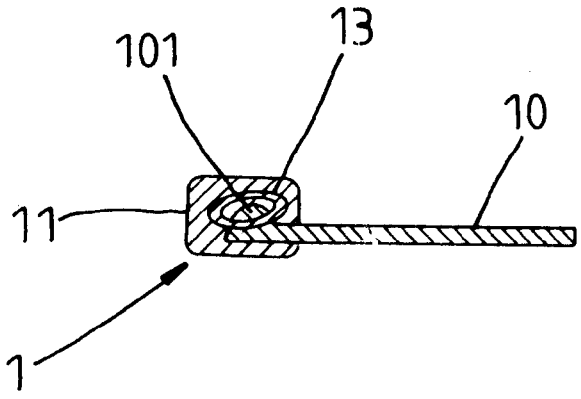
FIG. 3 is a cross-sectional view of one zipper tape of the nylon zip fastener according to the present invention.
Figure 4:
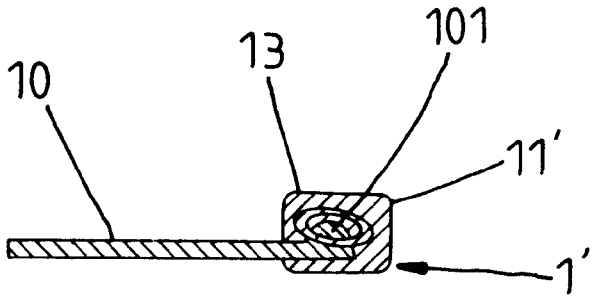
FIG. 4 is a cross-sectional view of the other zipper tape of the nylon zip fastener according to the present invention.
Figure 6:
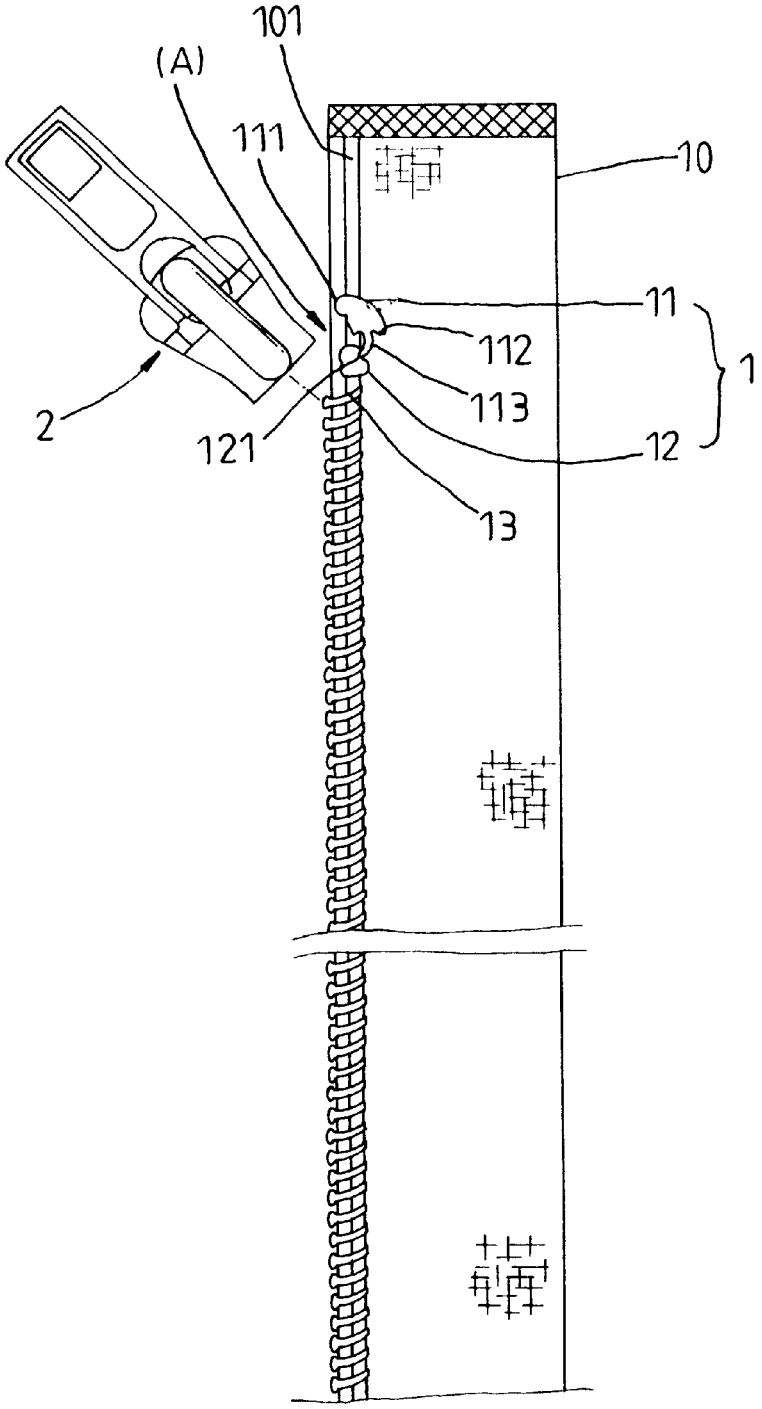
FIG. 6 is a plain view of a part of the present invention before insertion of the zipper slide into the open space between the top block and bottom block of the top-end piece of one zipper tape according to the present invention.

Referring to FIGS. 2–10, two zipper tapes 10 form with a zipper slide 2 a nylon zip fastener. Each zipper tape 10 has a longitudinal cord 101 extended along the outer longitudinal side thereof, a row of teeth 13 arranged along the outer longitudinal side and respectively passed over the longitudinal cord 101, a top-end piece 1 of 1' fixedly located on the longitudinal side 101 at the top end of the row of teeth 13. One top-end piece 1' is directly injection-molded on the corresponding zipper tap 10. According to the present preferred embodiment, the top-end piece 1' has a substantially c-shaped cross-section covered on the top end (the first tooth) of the respective row of teeth 13 and the bottom sidewall of the respective zipper tape 10 over the side edge of the outer longitudinal side of the respective zipper tape 10 (see FIG. 4). Alternatively, the top side of the top-end piece 1' may be extended over the top side of the first tooth of the row of teeth 13 and then covered downwards at right angles and covered over the protruding upper face of the first tooth of the row of teeth 13, i.e., the top-end piece 1' can be made to cover the top side and two opposite lateral sides of the first tooth of the row of teeth 13. The top-end piece 1' has an outer top stop edge 111' facing the other top-end piece 1, and a protruded inner stop portion 112' suspended above the respective zipper tape 10.

The other top-end piece 1 comprises a top block 11 injection-molded on the respective zipper tape 10, a bottom block 12, and an open space 5 between the top block 11 and the bottom block 12. The top block 11 has a substantially c-shaped cross-section (see FIG. 3) injection-molded on and covered over the respective zipper tape 10 and the first tooth of the respective row of teeth 13. The width of the top block 11 is wider than the teeth of the row of teeth 13. The top block 11 has an outer top edge 111 facing the outer stop edge 111' of the top-end piece 1, a protruded inner bottom stop potion 112 suspended above the respective zipper tape 10. The bottom block 12 is bonded to the respective zipper tape 10 by an ultrasonic sealing apparatus.

Figure 10:
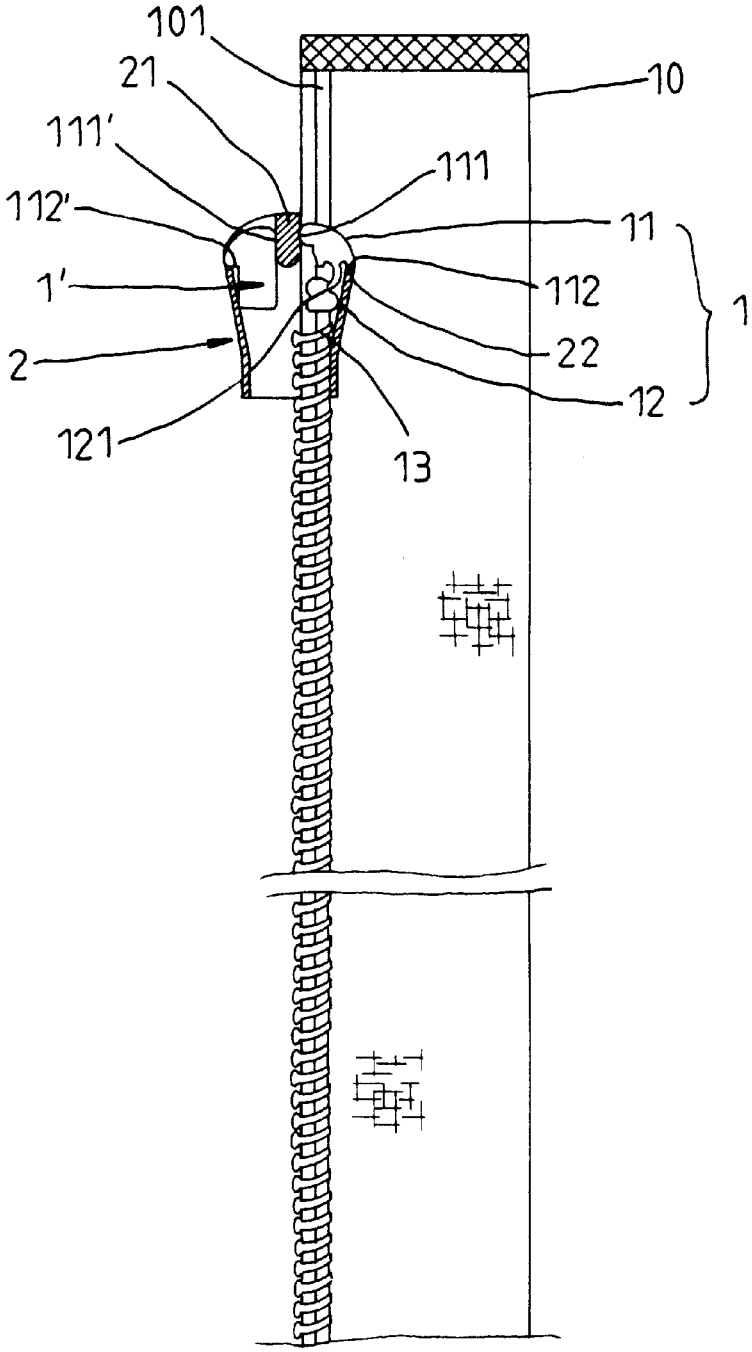
FIG. 10 is a sectional plain view of a part of the nylon zip fastener according to the present invention, showing the zipper slide coupled to the zipper tape, the spring hook forced into engagement with the recessed hole of the top block.

By means of the open space 5 between the top block 11 and the bottom block 12 (see FIGS. 6 and 7), the zipper slide 2 can easily be forced into engagement with the corresponding zipper tape 10 (se e FIGS. 9 and 10), keeping the outer top stop edge 111 of the top block 11 stopped against one side of the middle partition block 21 of the zipper slide 2 a nd protruded inner bottom stop portion 112 stopped against the front end of one sidewall 22 of the zipper slide 2 (see FIG. 10).

The main features of the present invention are outlined hereinafter. The top block 11 of the top-end piece 1 comprises a springy hook 113 downwardly extended from the bottom side toward the bottom block 12. The springy hook 113 has a tip 1131 hooked in a recessed hole 121 in the top side of the bottom block 12. When the zipper slide 2 forced through the open space 5 between the top block 11 and the bottom block 12 the zipper slide 2 into engagement with the corresponding zipper tape 10, the zipper slide 2 pushes the springy hook 113 away from the recessed hole 121 of the bottom block 12, and therefore the zipper slide 2 can easily be set into engagement with the corresponding zipper tape 10. When pulling the zipper slide 2 upwards after the zipper slide 2 has been coupled to the corresponding zipper tape 10, the springy hook 113 is forced inwards into engagement with the recessed hole 121 of the bottom block 12 by the lateral side wall of the zipper slide 2 to close the op en space 5, and therefore the zipper slide 2 is prohibited from falling out of the corresponding zipper tape 10.

When inserting the zipper slide 2 into the open space 5 between the top block 11 and the bottom block 12, the cord 101 of the corresponding zipper tape 10 at the area below the top block 11 can be bent inwards to disengage the springy hook 113 of the top block 11 from the recessed hole 121 of the bottom block 12 (see FIG. 8), so that the zipper slide 2 can be moved through the gap 4 between the springy hook 113 and the bottom block 12 into engagement with the corresponding zipper tape 10.

Figure 7:
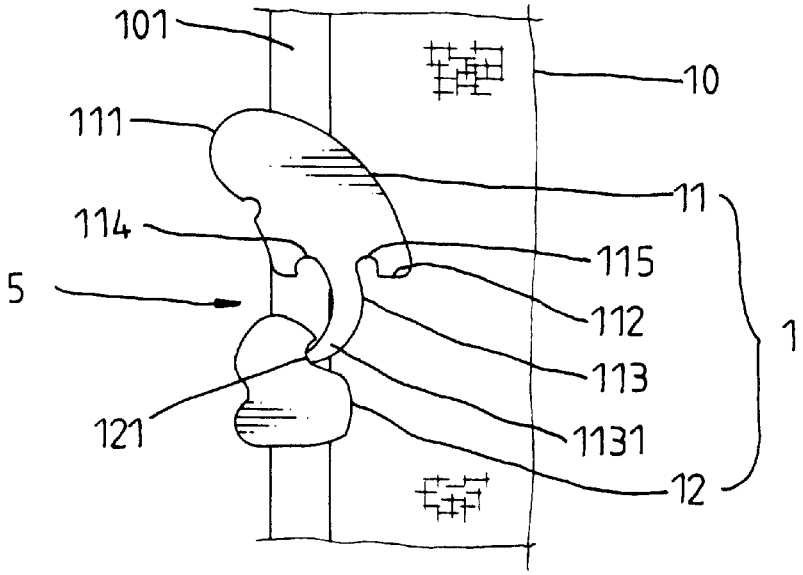
FIG. 7 is a plain view in an enlarged scale of a part of the present invention, showing the spring hook of the top block hooked in the recessed hole of the bottom block.
Figure 8:
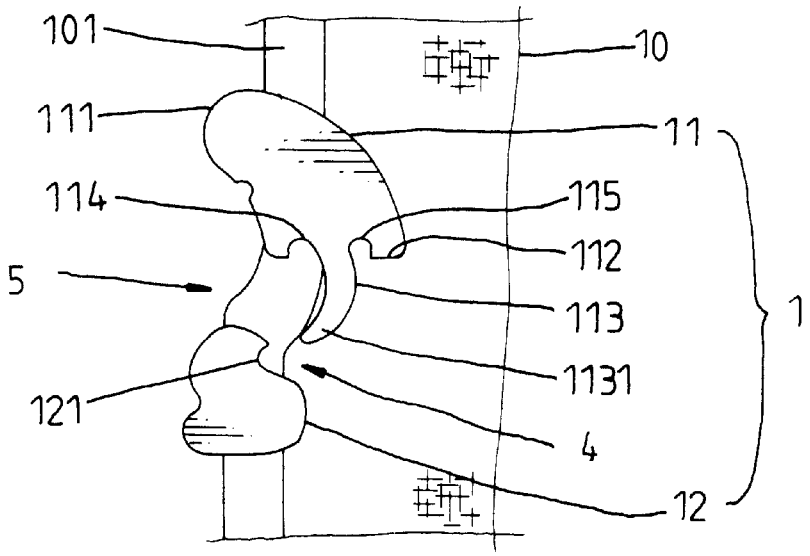
FIG. 8 is similar to FIG. 7 but showing the cord of the zipper tape bent in one direction, the spring hook disengaged from the recessed hole of the bottom block.
Figure 9:
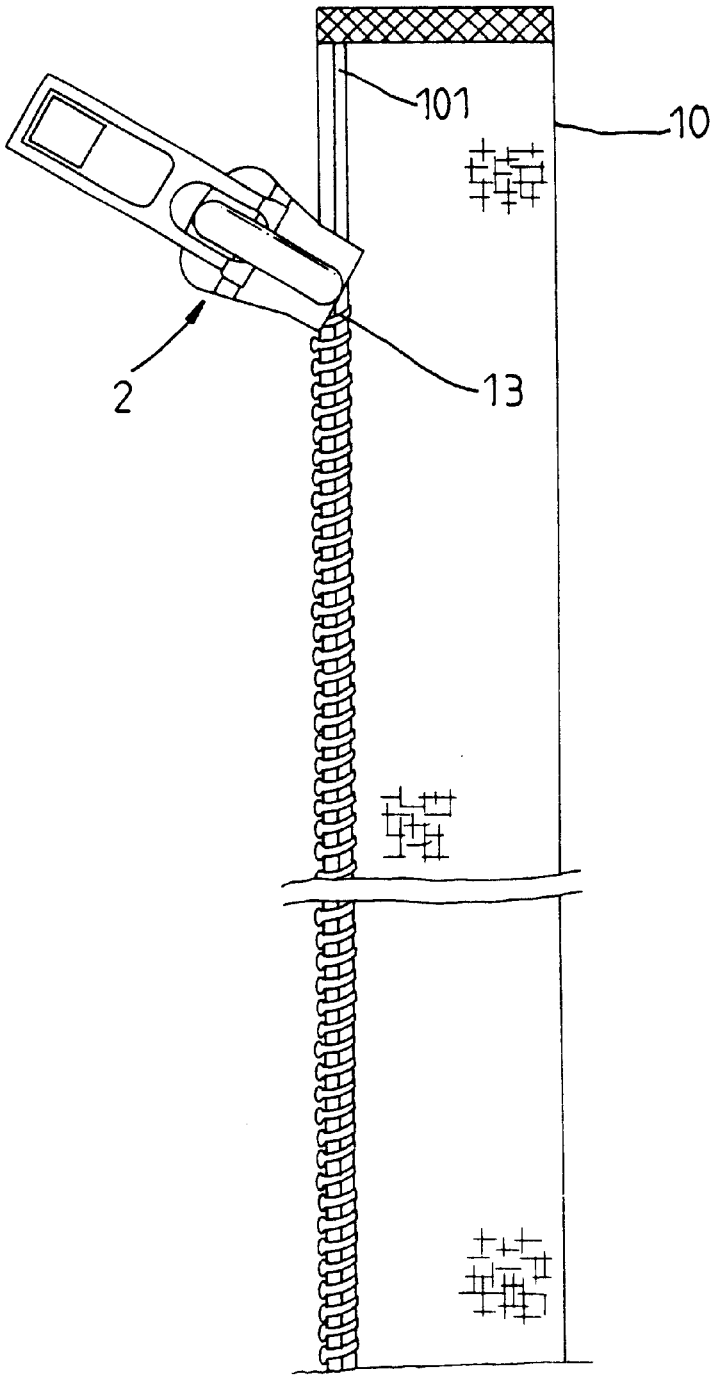
FIG. 9 is a plain view showing the zipper slide inserted into the open space between the top block and bottom block of the top-end piece of one zipper tape according to the present invention.

The top block 11 of the top-end piece 1 further comprises two bottom notches 114 and 115 at two sides of the top end (fixed end) of the springy hook 113 (see FIGS. 7 and 8). The formation of the bottom notches 1.14 and 115 in the bottom side of the top block 11 enhances the spring power of the springy hook 113.

The outer top stop edge 111 of the top block 11 is chamfered, preventing injury to the user's fingers. The corner edges of the bottom block 12 are also chamfered. Similarly, the outer top stop edge 111' and protruded inner stop portion 112' of the top-end piece 1' are chamfered, preventing injury to the user's fingers.

Figure 11:
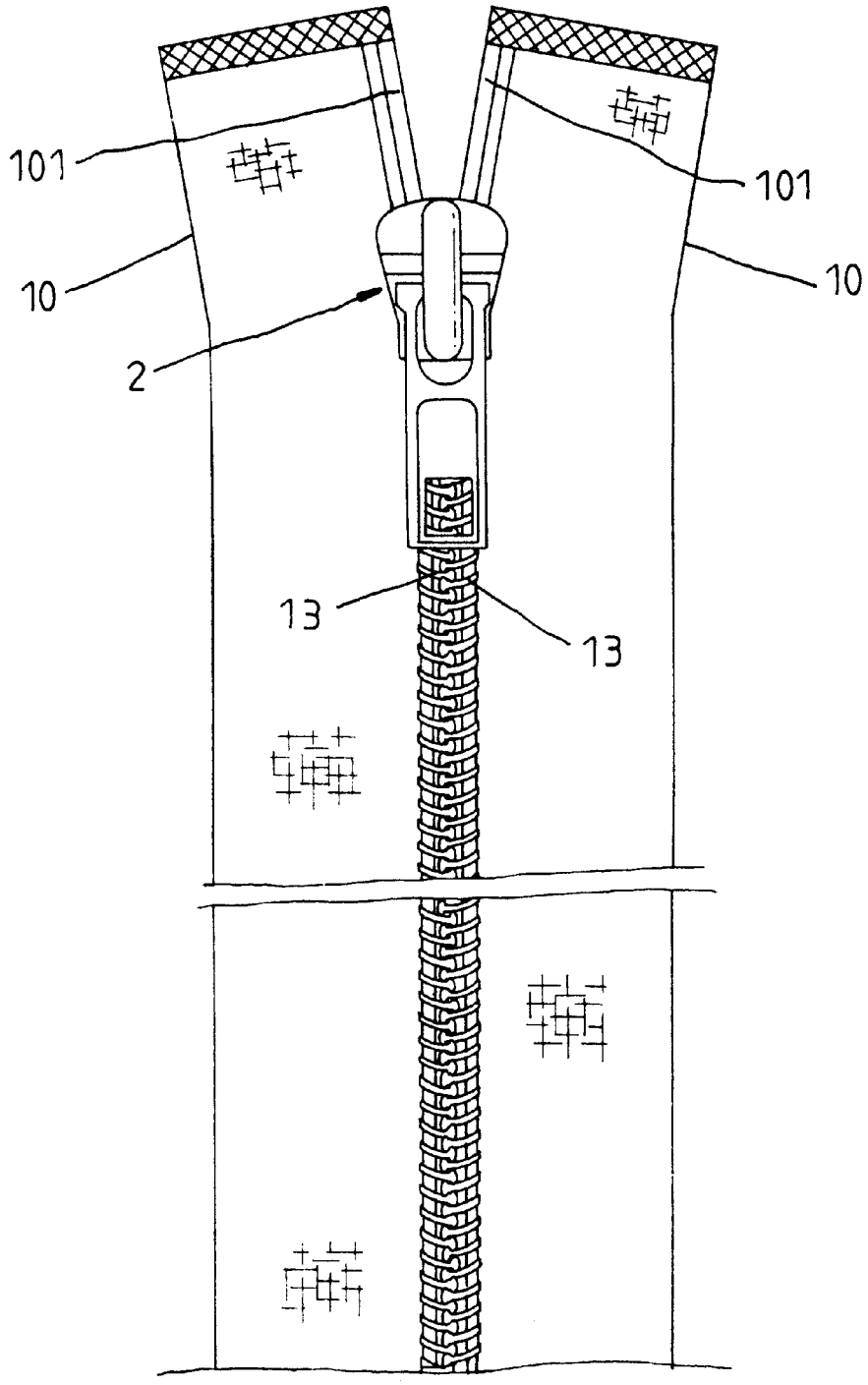
FIG. 11 is a plain view of the nylon zip fastener according to the present invention, showing the zipper slide moved to the upper limit position.
Figure 12:
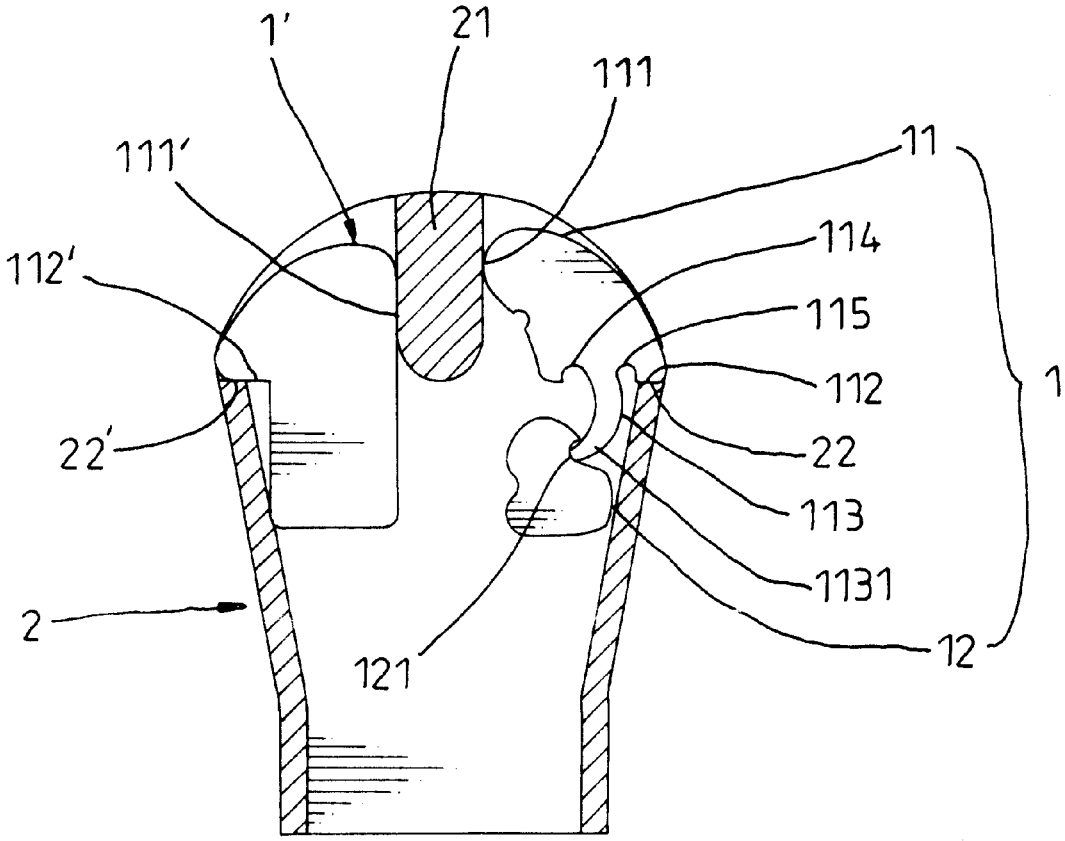
FIG. 12 is an enlarged view in section of a part of FIG. 11, showing the zipper slide stopped at the upper limit position.

Referring to FIGS. 11 and 12, when the zipper slide 2 pulled to the upper limit position to close the zip fastener, the outer top stop edge 111 and 111' of the top-end pieces 1 and 1' are respectively stopped against the two opposite lateral sides of the middle partition block 21 of the zipper slide 2, and the protruded inner stop portion 112' of one top-end piece 1' and the protruded inner bottom stop portion 112 of the other top-end piece 1 are respectively stopped at the top ends of the sidewalls 22 and 22' of the zipper slide 2, and therefore the zipper slide 2 is stopped from upward movement relative to the zipper tapes 10.

As indicated above, the present invention achieves the following advantages:

1. Because the top-end pieces covered over the top and bottom sidewalls of the zipper tape when installed, the top-end pieces do not fall from the zipper tapes even when received a strong external push force.
2. The springy hook of the top block is automatically forced into engagement with the recessed hole of the bottom block to close the passage between the top block and the bottom block when the zipper slide pulled to the upper limit position, and therefore the zipper slide does not fall out of the zipper tape.
3. The top-end pieces have chamfered corner edges, preventing injury to the user's fingers when opening or closing the zip fastener.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A zip fastener top-end piece arrangement comprising a zipper tape having a longitudinal row of teeth, and a top-end piece fixedly located on said zipper tape and a top end of said longitudinal row of teeth and adapted to limit upward movement of a sipper slide being coupled to said zipper tape, said top-end piece comprising a bottom block fixedly fastened to said zipper tape and said top end of said row of teeth and a top block injection-molded on said zipper tape and defining with said bottom block an open space, said top block having an outer top stop edge and a protruded inner bottom stop portion for stopping upward movement of the zipper slide being coupled to said zipper tape, wherein said top block comprises a springy hook downwardly extended from a bottom sidewall thereof toward the bottom block; said bottom block has a recessed hole disposed in a top side thereof and adapted to receive said springy hook; said springy hook being forced away from said recessed hole when the user insert a zipper slide through said open space into engagement with said zipper tape; said springy hook being forced into engagement with said recessed hole by the zipper slide being coupled to said zipper tape when the zipper slide being coupled to said zipper tape pulled upwards to said top block.

2. The zip fastener top-end piece arrangement as claimed in claim 1, wherein said top block has two bottom notches formed in the bottom sidewall at two sides of said springy hook.

* * * * *